US005829596A

United States Patent [19]

Budert

[11] Patent Number: 5,829,596

[45] Date of Patent: Nov. 3, 1998

[54] TOOL HOLDER

[75] Inventor: Guenter H. Budert, Bachhagel, Germany

[73] Assignee: Georg Knoblauch, Giengen, Germany

[21] Appl. No.: 890,242

[22] Filed: Jul. 9, 1997

[30] Foreign Application Priority Data

Aug. 9, 1996 [DE] Germany ..... 296 13 792 U

[51] Int. Cl.[6] ..... B65D 85/28

[52] U.S. Cl. ..... 206/379; 206/459.1; 206/349

[58] Field of Search ..... 206/349, 372–379, 206/459.1, 459.5, 443; 211/70.6, 69

[56] References Cited

U.S. PATENT DOCUMENTS

| | | | |
|---|---|---|---|
| 1,930,617 | 10/1933 | Huot | 206/379 |
| 4,227,613 | 10/1980 | Sietz | 206/459.1 |
| 5,148,914 | 9/1992 | Budert et al. | 206/379 |
| 5,687,844 | 11/1997 | Budert | 206/372 |
| 5,775,499 | 7/1998 | Budert | 206/379 |

*Primary Examiner*—Paul T. Sewell
*Assistant Examiner*—Luan K. Bui
*Attorney, Agent, or Firm*—Welsh & Katz, Ltd.

[57] ABSTRACT

The invention relates to a tool holder (1) for elongate tools (8) with a base part (2) and a cover (3). The base part (2) has a base plate (4), a tool-receiving chamber (6), enclosed by side walls (5), and mutually parallel receiving shafts (6A) which are separated from one another in said tool-receiving chamber by crosspieces (7) and in which the tools (8) are inserted. The receiving shafts (6A) are designed in each case with a bearing surface (6B) on the base plate (4) and with a depression (9), formed in the base plate (4), in the region of one of the side walls (5). The cover (3) may be connected to the base part (2) such that it can be displaced in the longitudinal direction of the receiving shafts (6A). The cover (3) has a selector device (10) which is intended for selecting one of the tools (8) positioned in the receiving shafts (6A) and has at least one elastic actuating element (11, 11'), which can be pressed onto at least one of the tools (8). The actuating element (11, 11') is designed with a protrusion (13, 13') which is directed towards the tools (8), such that, when the cover (3) is open, said actuating element presses a selected tool (8), by means of its end which is directed towards the side wall (5), into the depression (9), the tool (8) assuming, with its longitudinal axis, a position in which it runs obliquely with respect to the bearing surface (6B).

10 Claims, 4 Drawing Sheets

TOOL HOLDER

The invention relates to a tool holder for elongate tools, in particular drill bits, with a base part and a cover.

The known tool holders for drill bits usually have a base part, a means for receiving drill bits and a cover, the cover either being displaceable relative to the base part or being mounted pivotably on the base part.

In the case of a drill-bit tool holder which is known in practice, the base part is provided with a base plate which is formed integrally with side walls such that a tool-receiving chamber with receiving shafts in which drill bits are inserted is provided in the base plate, the receiving shafts being formed by mutually parallel crosspieces.

The cover of this known tool holder is fitted on the base part such that it can be displaced in the longitudinal direction of the receiving shafts.

When the cover of such a tool holder is displaced for the purpose of opening the latter, it is possible to grasp all the drill bits located in the holder, although, in particular in the case of relatively small diameters, there is the problem that very often the wrong drill bit is removed from the holder and the desired drill bit is only grasped after a number of attempts.

Furthermore, it may also, disadvantageously, be the case with such tool holders that, in addition to the abovementioned mix-up between the drill bits, two drill bits of small diameter are grasped at the same time relatively.

G 295 13 388.0 discloses a tool holder of improved design which is provided for elongate tools, in particular drill bits, and has a base part, a device for receiving tools and a cover, the device for receiving tools and/or the cover being fitted on the base in a movable manner, and the device for receiving tools having openings or shafts for the insertion of the drill bits. The cross-sectional area and/or the line of the cross-sectional area of at least part of the openings or shafts in which the tools are inserted can be decreased by means of at least one elastically deformable member per opening or shaft. In the non-deformed state, the elastically deformable member projects at least partially into the area which, once the tool has been inserted into the respective opening or shaft, would be taken up by said tool.

This known tool holder advantageously secures the tools located in the holder, such that said tools cannot slip in the receiving shafts and, in the event of the tool holder being opened, cannot drop out of their receiving means.

However, it is not possible for a specific tool to be selected in this known tool holder either, with the result that, here too, there is the risk of mixing-up or of grasping more than one tool at a time.

A bowl-shaped drill-bit container is also known in practice, this container having, on the outer circumference, a scale with designations of the tools, or drill bits, located in the radially arranged shafts.

Positioned on the bowl-shaped container, in which the tools are inserted vertically, is a cover, which is likewise bowl-shaped and has a circular opening through which a selected drill bit can pass when the entire tool container is turned around such that the cover is directed downwards.

A disadvantage with this known tool container is that the desired drill bit, rather than passing through the opening in the cover of its own accord, can only be removed if the entire tool container is turned upside down.

A further disadvantage of this container is that, on account of the bowl-shaped design, the storage of a number of such containers involves considerable problems as regards stacking.

The object of the present invention is to provide a tool holder for elongate tools, in particular drill bits, which makes it possible, by way of a straightforward and cost-effective mechanism, for a specific tool located in the tool holder to be selected, it being possible for the selected tool to be removed from the tool holder without difficulty.

This object is achieved according to the invention by the features specified in claim 1.

The advantage of the invention is that, in stark contrast to the prior art, it is possible to select a specific tool located in the tool holder.

This takes place in a simple manner, as the cover is opened by virtue of displacement, by a user activating an actuating element for a defined tool. By virtue of a protrusion which is directed towards the tools, said actuating element presses the selected tool, or a drill bit, by means of one end, into the depression in the base plate, with the result that, on account of the oblique position with respect to the bearing surface, the other end of the tool is swung out of its bearing surface and can thus easily be removed.

Since the selected tool projects out of the plane of the rest of the tools to a considerable extent, the risk of any mix-up with other tools in the holder can virtually be ruled out.

By virtue of the configuration according to the invention of the tool holder, the possibility of stacking a number of tool holders is, advantageously, not hindered by the selector device.

Further advantages and advantageous developments of the present invention can be gathered from the sub-claims and the exemplary embodiments, which are described, in principle, with reference to the drawing, in which:

FIGS. 1 to 6 illustrate a tool holder 1 with elongate tools 8 positioned therein, these tools being drill bits in the present exemplary embodiment.

Figure 1:
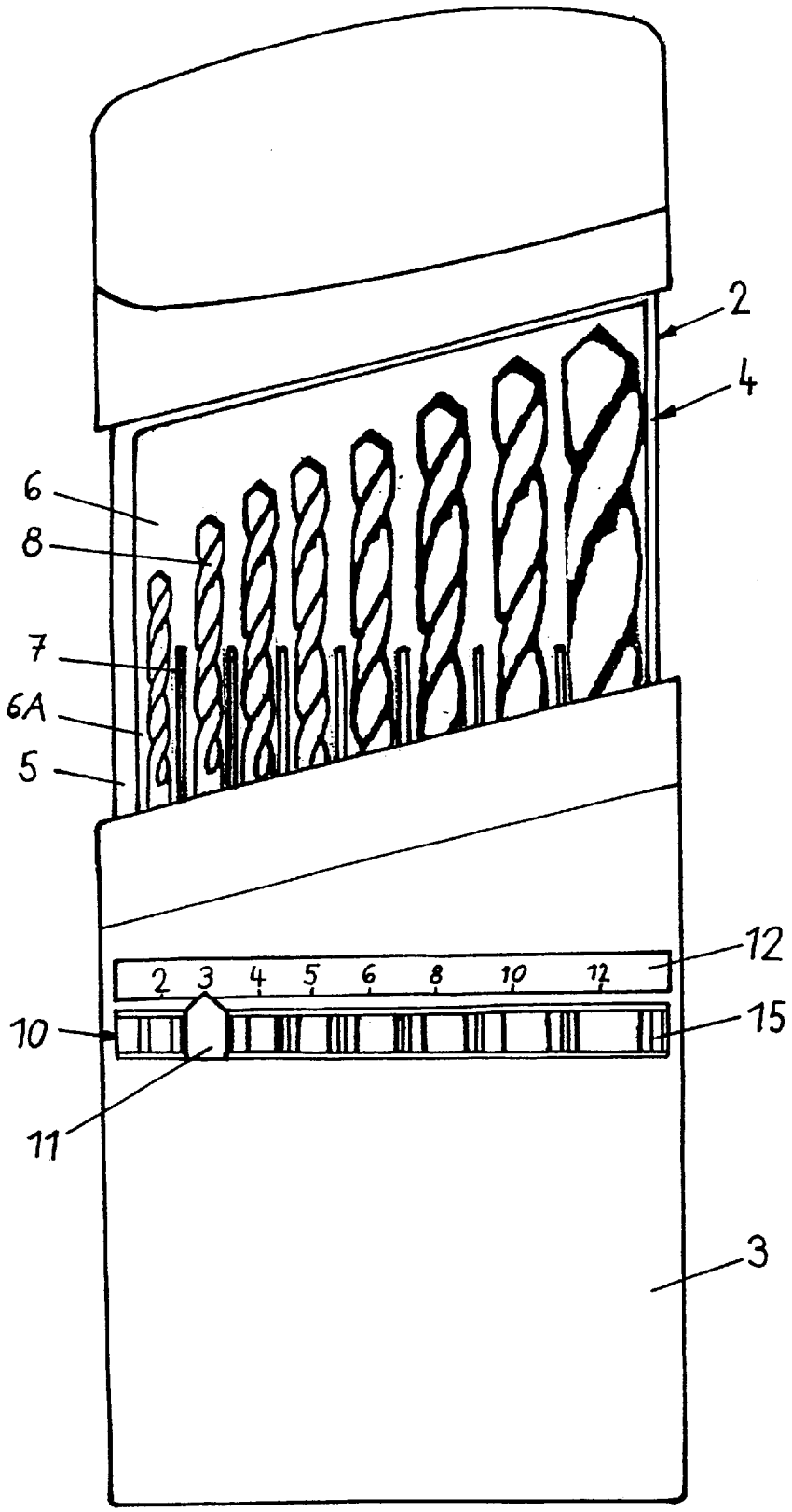
FIG. 1 shows a plan view of a tool holder with the cover open, said tool holder having a selector device with lugs punched out of the cover.

The tool holder 1 has a base part 2 and a cover 3, the base part 2 having a base plate 4 which is designed, around its periphery, with side walls 5 and thus has a tool-receiving chamber 6.

Arranged in the tool-receiving chamber 6 are crosspieces 7 which are formed integrally with the base plate 4 and separate from one another various mutually parallel receiving shafts 6A in which tools 8 are positioned.

The receiving shafts 6A are designed with a bearing surface 6B on the base plate 4, said bearing surface being aligned horizontally with respect to the longitudinal direction of the tool holder 1 and on which the greatest part of each of the tools 8 bears in each case.

In the region of the bottom narrow side of the tool holder 1, the base plate 4 is provided with a depression 9, which constitutes a cavity beneath the drill bits positioned in the holder 1.

The cover 3 of the tool holder 1 is connected to the base part 2 such that it can be displaced in the longitudinal direction of the receiving shaft 6A.

In order to select a specific tool 8 which is positioned in the tool holder 1, the cover 3 has a selector device 10. With the aid of an elastic actuating element 11, 11', a specific tool 8 in one of the receiving shafts 6A is selected as the cover 3 is opened, help being given by a scale 12 which is provided on the cover 3 and has a graduation from which it can be seen which tool is located in the receiving shafts 6A in each case.

By means of a protrusion 13, 13' which is directed towards the drill bits 8, the actuating element 11, 11' presses onto the selected tool, which is pressed into the depression 9 by means of its bottom shank end, with the result that said tool assumes an oblique position with respect to the bearing surface 6B and, from the bearing position, is pivoted towards the user by means of its front end, or the drill-bit tip.

Figure 2:
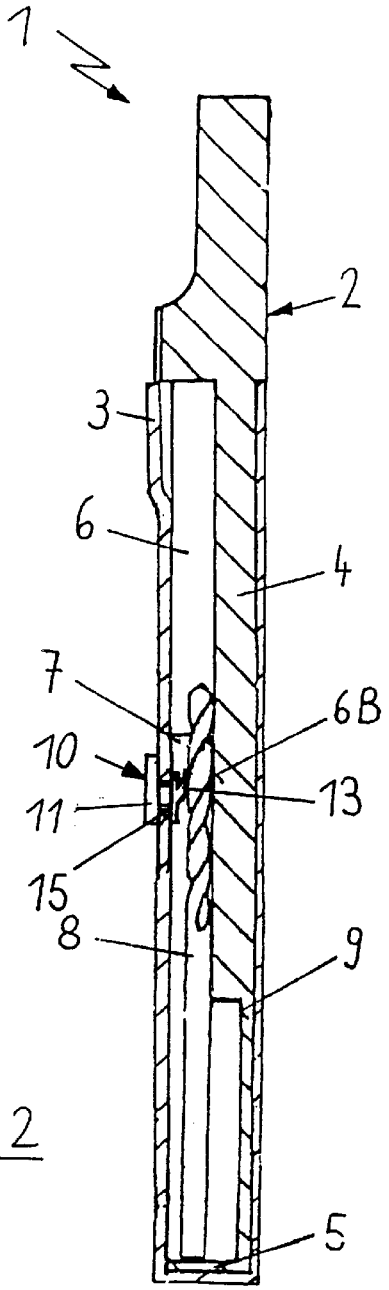
FIG. 2 shows, in section, a side view of the tool holder according to FIG. 1 with the cover closed.
Figure 3:
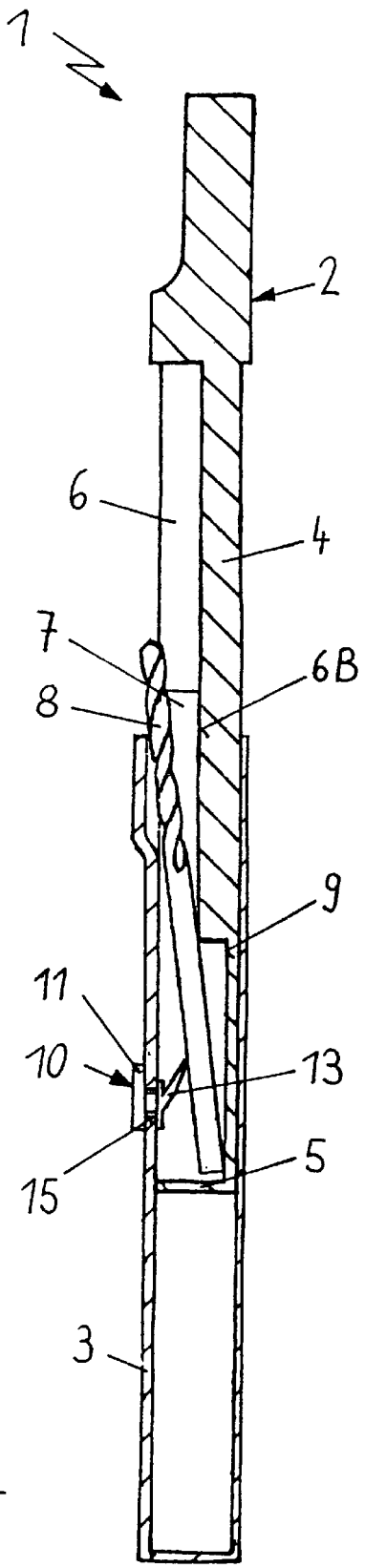
FIG. 3 shows, in section, a side view of the tool holder according to FIG. 1 with the cover open.

FIGS. 1 to 3, in particular, illustrate a tool holder 1 with a selector device 10 which has one actuating element 11' for each of the receiving shafts 6A, said actuating element being formed as an elastic lug which is punched out of the cover 3. In the event of the cover being opened, and thus displaced, a user can press said lug 11', by means of the protrusion 13', which is designed in the form of a hemisphere in this exemplary embodiment and is located on that side of the lug 11' which is directed towards the tool, onto a selected tool 8, in which case the latter—as has been described above —is pressed, by means of its bottom end, into the depression 9 and assumes a protruding, removal position.

In order to facilitate use, an elevation 14 is formed in each case on the top side of the lugs 11', said elevation permitting targeted selection of the tools 8.

Since the elevation 14, which is directed towards the tools 8, is also subjected to prestressing when the cover 3 is closed, said elevation presses onto the tools 8 in each case such that they are secured in the receiving shafts 6A against slipping.

In order, as a result of this prestressing, to prevent the cover 3 from being raised up from the base part 2, the cover 3 is arrested on the base part 2 in a direction perpendicular to its displacement direction.

The embodiment illustrated in FIGS. 1 to 3, in which a desired drill bit 8 is lifted by a lug 11' being pressed down, this thus allowing the drill bit to be easily removed, is distinguished, in particular, by its very straightforward and cost-effective design.

As an alternative to the exemplary embodiment according to FIGS. 1 to 3, FIGS. 4 to 6 illustrate a variant of a tool holder 1 in which the selector device 10 is designed with a single actuating element 11, which can be displaced in a guide slit 15 running transversely with respect to the longitudinal direction of the receiving shafts 6A.

The actuating element 11 thus constitutes a slide which, as a protrusion 13 which is directed towards the tools 8, has a prism-like, elastic tongue which is formed integrally with the slide 11.

When, with the cover closed, the slide 11 is set to a desired tool in accordance with the scale 12, the elastic tongue 13 presses onto the selected tool 8. As the sliding cover 3 is opened, the prism-like tongue presses the shank end of the desired drill bit 8 into the depression 9, as a result of which said drill bit, in turn, is pivoted into a protruding, removal position.

Figure 4:
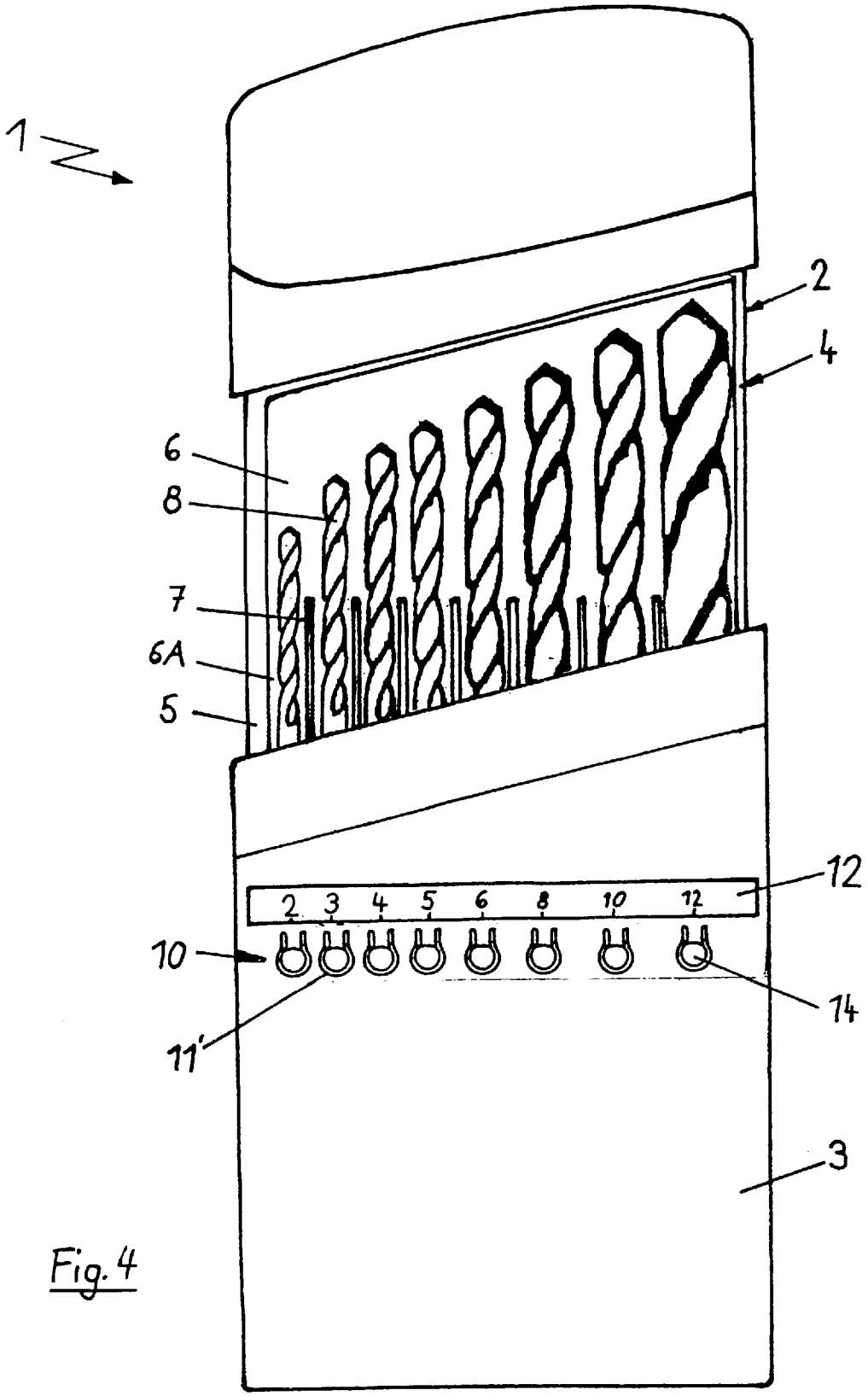
FIG. 4 shows a plan view of a tool holder with the cover open, said tool holder having a selector device with a slide.
Figure 5:
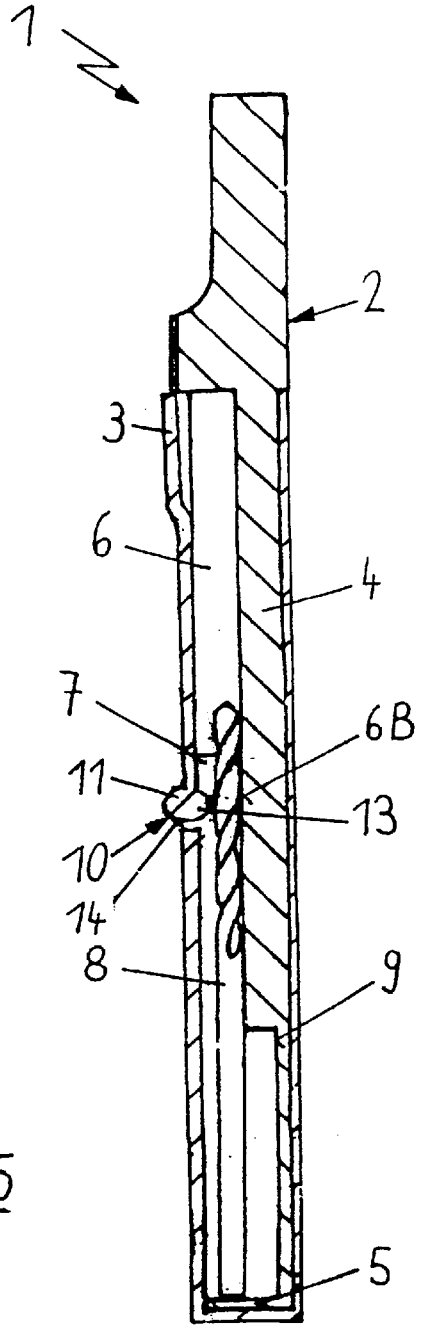
FIG. 5 shows, in section, a side view of the tool holder according to FIG. 4 with the cover closed.
Figure 6:
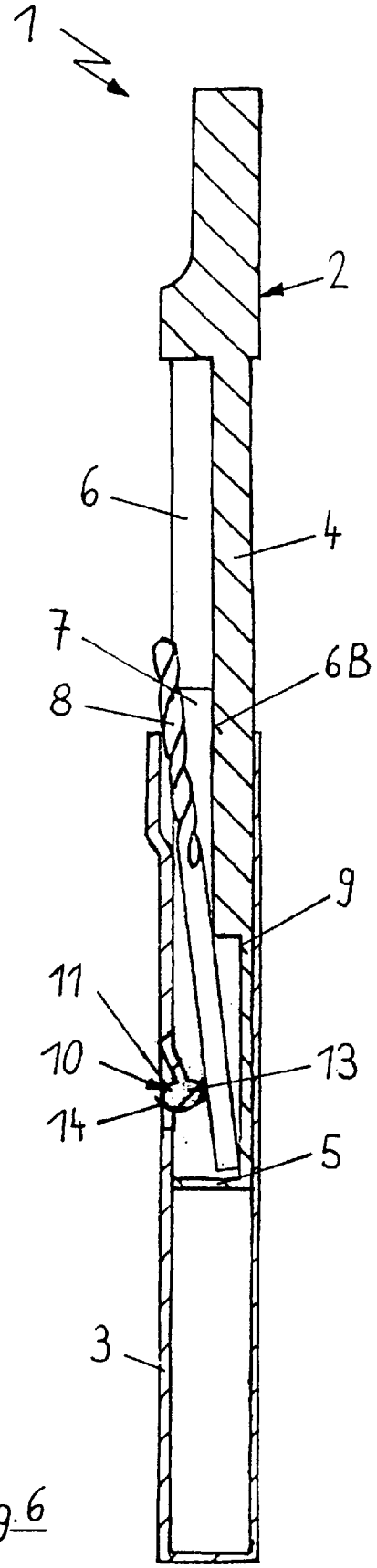
FIG. 6 shows, in section, a side view of the tool holder according to FIG. 4 with the cover open.

It is also the case that the variant shown in FIGS. 4 to 6, this variant corresponding, in principle, to the exemplary embodiment according to FIGS. 1 to 3, is distinguished by being extremely easy to use.

In order to increase the user-friendliness of the tool holder 1 even more, the tool holders illustrated in FIGS. 1 to 6 may each have a transparent cover 3 and a suspension device or other conventional features.

Of course, the basic inventive idea—a tool holder in which a tool can be selected and said tool is automatically pivoted forwards as the tool holder is opened—is independent of the actual exemplary embodiments outlined above. Thus, it is possible to conceive of a large number of tool holders which have the selector device according to the invention.

I claim:

1. A tool holder (1) for elongate tools (8) with a base part (2) and a cover (3), the base part (2) having a base plate (4), a tool-receiving chamber (6), enclosed by side walls (5), and mutually parallel receiving shafts (6A) which are separated from one another in said tool-receiving chamber by cross-pieces (7) and into which the tools (8) are inserted, the receiving shafts (6A) are designed in each case with a bearing surface (6B) on the base plate (4) and with a depression (9), formed in the base plate (4), in the region of one of the side walls (5), it being possible for the cover (3) to be connected to the base part (2) such that it can be displaced in the longitudinal direction of the receiving shafts (6A), the cover (3) having a selector device (10) which is intended for selecting one of the tools (8) positioned in the receiving shafts (6A) and which has at least one elastic actuating element (11, 11'), which can be pressed on at least one of the tools (8), the actuating element (11, 11') being designed with a protrusion (13, 13') which is directed towards the tools (8), such that, when the cover (3) is open, said actuating element presses a selected tool (8), by means of its end which is directed towards the side wall (5), into the depression (9), the tool (8) assuming, with its longitudinal axis, a position in which it runs obliquely with respect to the bearing surface (6B).

2. The tool holder as claimed in claim 1, wherein the selector device (10) is designed such that one actuating element (11') is provided for each of the receiving shafts (6A).

3. The tool holder as claimed in claim 2, wherein the actuating element (11') is designed as an elastic lug which is punched out of the cover (3) and can be moved against a tool (8) positioned in the receiving shaft (6A).

4. The tool holder as claimed in claim 3, wherein, in addition to the protrusion (13'), which is directed towards the tools (8), there is an elevation (14) on the top side of the lug (11').

5. The tool holder as claimed in claim 1, wherein, when the cover (3) is closed, the elevation (14), which is directed towards the tools (8), presses onto the tools (8) in each case such that the latter are secured in the receiving shafts (6A) against slipping.

6. The tool holder as claimed in claim 1, wherein the selector device (10) is designed such that a guide slit (15) is formed in the cover (3) transversely with respect to the longitudinal direction of the receiving shafts (6A), and has a single actuating element (11) arranged displaceably in it.

7. The tool holder as claimed in claim 6, wherein the actuating element (11) is designed as a slide and the protrusion (13), which is directed towards the tools (8), is designed as a prism-like, elastic tongue which is connected to said slide and, when the cover (3) is closed, presses, with prestressing, onto one of the tools (8).

8. The tool holder as claimed in claim 1, wherein the cover (3) is arrested on the base part (2) in a direction perpendicular to its displacement direction.

9. The tool holder as claimed in claim 1, wherein the cover (3) has a scale (12), the graduation of the scale being provided such that in each case one scale unit is assigned to one of the receiving shafts (6A).

10. The tool holder as claimed in claim 1, wherein the cover (3) is transparent at least in the region of a viewing window.

* * * * *